United States Patent [19]

Kopatz et al.

[11] Patent Number: 4,927,456

[45] **Date of Patent: * May 22, 1990**

[54] HYDROMETALLURGICAL PROCESS FOR PRODUCING FINELY DIVIDED IRON BASED POWDERS

[75] Inventors: Nelson E. Kopatz, Sayre; Walter A. Johnson; Joseph E. Ritsko, both of Towanda, all of Pa.

[73] Assignee: GTE Products Corporation, Stamford, Conn.

[ * ] Notice: The portion of the term of this patent subsequent to Feb. 9, 2005 has been disclaimed.

[21] Appl. No.: 54,479

[22] Filed: May 27, 1987

[51] Int. Cl.[5] ..... B22F 1/00; B22F 9/24

[52] U.S. Cl. ..... 75/346; 75/360; 75/365

[58] Field of Search ..... 75/0.5 BB, 0.5 AA, 0.5 AA, 75/0.5 BA; 264/14.0

[56] References Cited

U.S. PATENT DOCUMENTS

| | | | |
|---|---|---|---|
| 2,735,757 | 2/1956 | Zapf | 75/0.5 AA |
| 3,652,259 | 3/1972 | Knopp | 75/0.5 B |
| 3,663,667 | 5/1972 | Cheney et al. | 264/14 |
| 3,909,241 | 9/1975 | Cheney et al. | 75/0.5 B |
| 3,974,245 | 8/1976 | Cheney et al. | 75/0.5 BB |
| 4,042,374 | 8/1977 | Rasmussen et al. | 75/0.5 B |
| 4,348,224 | 9/1982 | Gingerich et al. | 75/0.5 AA |
| 4,397,682 | 8/1983 | Watanable et al. | 75/0.5 A |
| 4,533,382 | 9/1985 | Miuara et al. | 75/0.5 C |
| 4,615,736 | 10/1986 | Armor et al. | 75/0.5 A |
| 4,670,047 | 6/1987 | Kopatz et al. | 75/0.5 B |
| 4,687,511 | 8/1987 | Paliwal et al. | 75/0.5 B |
| 4,705,560 | 11/1987 | Kemp, Jr. et al. | 75/0.5 BB |
| 4,723,993 | 2/1988 | Kopatz et al. | 75/0.5 A |
| 4,731,110 | 3/1988 | Kopatz et al. | 75/0.5 A |
| 4,731,111 | 3/1988 | Kopatz et al. | 75/0.5 AB |

FOREIGN PATENT DOCUMENTS

| | | | |
|---|---|---|---|
| 0175824 | 4/1986 | European Pat. Off. | 75/0.5 A |
| 0150828 | 8/1986 | Japan | 75/0.5 A |
| 1174301 | 8/1986 | Japan | 75/0.5 A |
| 0224076 | 8/1977 | U.S.S.R. | 75/0.5 A |

*Primary Examiner*—Jeffrey E. Russel

*Attorney, Agent, or Firm*—Donald R. Castle

[57] ABSTRACT

A process for producing finely divided spherical iron group based metallic powders comprises forming an aqueous solution containing a source of the appropriate metal sources in a mineral acid, forming a reducible iron group based material from the solution, reducing the material to iron group based metal powder particles, subjecting the metal particles to a high temperature zone to melt a portion of the particles and to form droplets and cooling the droplets to form an essential spherical iron group based metallic powders.

13 Claims, No Drawings

HYDROMETALLURGICAL PROCESS FOR PRODUCING FINELY DIVIDED IRON BASED POWDERS

CROSS REFERENCE TO RELATED APPLICATIONS

This invention is related to the following applications: Ser. No. 054,577, filed 5/27/87, entitled, "Hydrometallurgical Process for Producing Finely Divided Spherical Metal Alloy Powders"; Ser. No. 026,312, is now U.S. Pat. No. 4,731,111 filed 3/16/87, entitled, "Hydrometallurgical Process for Producing Finely Divided Spherical Refractory Metal Alloy Powders"; Ser. No. 028,824, is now U.S. Pat. No. 4,723,993 filed 3/23/87, entitled, Hydrometallurgical Process for Producing Finely Divided Spherical Low Melting Temperature Powders"; Ser. No. 026,222, is now U.S. Pat. No. 4,731,110 filed 3/16/87, entitled, "Hydrometallurgical Process for Producing Finely Divided Spherical Precious Metal Alloy Powders"; Ser. No. 054,553, now U.S. Pat. No. 4,778,517, filed 5/27/87, entitled, "Hydrometallurgical Process For Producing Finely Divided Copper and Copper Alloy Powders"; all of which are by the same inventors as this application and assigned to the same assignee.

FIELD OF THE INVENTION

This invention relates to the preparation of iron group based metal alloy powders. More particularly it relates to the production of such powders having substantially spherical particles.

BACKGROUND OF THE INVENTION

U.S. Pat. No. 3,663,667 discloses a process for producing multimetal alloy powders. Thus, multimetal alloy powders are produced by a process wherein an aqueous solution of at least two thermally reducible metallic compounds and water is formed, the solution is atomized into droplets having a droplet size below about 150 microns in a chamber that contains a heated gas whereby discrete solid particles are formed and the particles are thereafter heated in a reducing atmosphere and at temperatures from those sufficient to reduce said metallic compounds to temperatures below the melting point of any of the metals in said alloy.

U.S. Pat. No. 3,909,241 relates to free flowing powders which are produced by feeding agglomerates through a high temperature plasma reactor to cause at least partial melting of the particles and collecting the particles in a cooling chamber containing a protective gaseous atmosphere where the particles are solidified. In this patent the powders are used for plasma coating and the agglomerated raw materials is produced from slurries of metal powders and binders. Both the U.S. Pat. Nos. 3,663,667 and 3,909,241 are assigned to the same assignee as the present invention.

In European patent application WO8402864 published Aug. 2, 1984, also assigned to the assignee of this invention, there is disclosed a process for making ultrafine powder by directing a stream of molten droplets at a repellent surface whereby the droplets are broken up and repelled and thereafter solidified as described therein. While there is a tendency for spherical particles to be formed after rebounding, it states that the molten portion may form elliptical shaped or elongated particles with rounded ends.

Iron metal based powders heretofore have been produced by gas or water atomization of molten alloys or precipitation from solutions such as in U.S. Pat. No. 3,663,667 issued to the same assignee as the present invention. That patent discloses one method of obtaining solids metal values from a solution. All three processes have some obvious technical drawbacks. Gas atomization can produce a spherical particle morphology, however, yields of fine powder can be quite low as well as potential losses to skull formation in the crucible. Water atomization has the same disadvantage as gas atomization, moreover, it produces an irregular shaped particle which may be undesirable for certain applications. Resulting powder from water atomization usually has a higher oxygen content which may be detrimental in certain material applications. The third process, precipitation from solutions followed by reduction to the metal or metal alloy can be quite attractive from the cost standpoint. Drawbacks are related to the lack of product sphericity and in some instance agglomeration during reduction which lowers the yield of the preferred fine powder of a size below about 20 micrometers.

Fine iron group metal based powders such as iron, cobalt, and nickel and their alloys are useful in applications such as electronics, magnets, superalloys, and brazing alloys. Typically, materials used in microcircuits have a particle size of less than about 20 micrometers as shown in U.S. Pat. No. 4,439,468.

By the term "iron group metal based material" it is meant that the iron group metal constitutes the major portion of the material thus includes the iron group metal per se as well as alloys in which the iron group metal is the major constituent, normally above about 50% by weight of the alloy but in any event the iron group metal or iron group metals are the constituent or constituents having the largest percentage by weight of the total alloy.

It is believed therefore that a relatively simple process which enables finely divided iron metal and iron metal alloy powders to be hydrometallurgically produced and thermally spheroidized from sources of the individual metals in an advancement in the art.

SUMMARY OF THE INVENTION

In accordance with one aspect of this invention there is provided a process for producing metal powders from the iron group of metals. The process involves forming an aqueous solution of at least one iron group metal, removing sufficient water from said solution to form a reducible metal iron group metal compound reducing the compound to the metal particles entraining at least a portion of the metal particles that have an average particle size less than about 20 micrometers in a carrier gas, feeding the entrained particles and the gas to a high temperature zone to melt at least a portion of the particles and cooling the molten material to form solid spherical particles of the foregoing metals which particles have an average particle size of less than about 20 micrometers.

DETAILS OF THE PREFERRED EMBODIMENTS

For a better understanding of the present invention, together with other and further objects, advantages, and capabilities thereof, reference is made to the following disclosure and appended claims in connection with the foregoing description of some of the aspects of the invention.

While it is preferred to use metal powders as starting material in the practice of this invention because such materials dissolve more readily than other forms of metals, however, use of the powders is not essential. Metallic salts that are soluble in water or in an aqueous mineral acid can be used. When alloys are desired, the metallic ratio of the various metals in the subsequently formed solids of the salts, oxides or hydroxides can be calculated based upon the raw material input or the solid can be sampled and analyzed for the metal ratio in the case of alloys being produced. The metal values can be dissolved in any water soluble acid. The acids can include the mineral acids as well as the organic acids such as acetic, formic and the like. Hydrochloric is especially preferred because of cost and availability.

After the metal sources are dissolved in the aqueous acid solution, the resulting solution can be subjected to sufficient heat to evaporate water. The metal compounds, for example, the oxides, hydroxides, sulfates, nitrates, chlorides, and the like, will precipitate from the solution under certain pH conditions. The solid materials can be separated from the resulting aqueous phase or the evaporation can be continued. Continued evaporation results in forming particles of a residue consisting of the metallic compounds. In some instances, when the evaporation is done in air, the metal compounds may be the hydroxides, oxides or mixtures of the mineral acid salts of the metals and the metal hydroxides or oxides. The residue may be agglomerated and contain oversized particles. The average particle size of the materials can be reduced in size, generally below about 20 micrometers by milling, grinding or by other conventional methods of particle size reduction.

After the particles are reduced to the desired size they are heated in a reducing atmosphere at a temperature above the reducing temperature of the salts but below the melting point of the metals in the particles. The temperature is sufficient to evolve any water of hydration and the anion. If hydrochloric acid is used and there is water of hydration present the resulting wet hydrochloric acid evolution is very corrosive thus appropriate materials of construction must be used. The temperatures employed are below the melting point of any of the metals therein but sufficiently high to reduce and leave only the cation portion of the original molecule. In most instances a temperature of at least about 500° C. is required to reduce the compounds. Temperatures below about 500° C. can cause insufficient reduction while temperatures above the melting point of the metal result in large fused agglomerates. If more than one metal is present the metals in the resulting multimetal particles can either be combined as intermetallics or as solid solutions of the various metal components. In any event there is a homogeneous distribution throughout each particle of each of the metals. The particles are generally irregular in shape. If agglomeration has occurred during the reduction step, particle size reduction by conventional milling, grinding and the like can be done to achieve a desired average particle size for example less than about 20 micrometers with at least 50% being below about 20 micrometers.

In preparing the powders of the present invention, a high velocity stream of at least partially molten metal droplets is formed. Such a stream may be formed by any thermal spraying technique such as combustion spraying and plasma spraying. Individual particles can be completely melted (which is the preferred process), however, in some instances surface melting sufficient to enable the subsequent formation of spherical particles from such partially melted particles is satisfactory. Typically, the velocity of the droplets is greater than about 100 meters per second, more typically greater than 250 meters per second. Velocities on the order of 900 meters per second or greater may be achieved under certain conditions which favor these speeds which may include spraying in a vacuum.

In the preferred process of the present invention, a powder is fed through a thermal spray apparatus. Feed powder is entrained in a carrier gas and then fed through a high temperature reactor. The temperature in the reactor is preferably above the melting point of the highest melting component of the metal powder and even more preferably considerably above the melting point of the highest melting component of the material to enable a relatively short residence time in the reaction zone.

The stream of dispersed entrained molten metal droplets may be produced by plasma-jet torch or gun apparatus of conventional nature. In general, a source of metal powder is connected to a source of propellant gas. A means is provided to mix the gas with the powder and propel the gas with entrained powder through a conduit communicating with a nozzle passage of the plasma spray apparatus. In the arc type apparatus, the entrained powder may be fed into a vortex chamber which communicates with and is coaxial with the nozzle passage which is bored centrally through the nozzle. In an arc type plasma apparatus, an electric arc is maintained between an interior wall of the nozzle passage and an electrode present in the passage. The electrode has a diameter smaller than the nozzle passage with which it is coaxial to so that the gas is discharged from the nozzle in the form of a plasma jet. The current source is normally a DC source adapted to deliver very large currents at relatively low voltages. By adjusting the magnitude of the arc powder and the rate of gas flow, torch temperatures can range from 5500 degrees centigrade up to about 15,000 degrees centigrade. The apparatus generally must be adjusted in accordance with the melting point of the powders being sprayed and the gas employed. In general, the electrode may be retracted within the nozzle when lower melting powders are utilized with an inert gas such as nitrogen while the electrode may be more fully extended within the nozzle when higher melting powders are utilized with an inert gas such as argon.

In the induction type plasma spray apparatus, metal powder entrained in an inert gas is passed at a high velocity through a strong magnetic field so as to cause a voltage to be generated in the gas stream. The current source is adapted to deliver very high currents, on the order of 10,000 amperes, although the voltage may be relatively low such as 10 volts. Such currents are required to generate a very strong direct magnetic field and create a plasma. Such plasma devices may include additional means for aiding in the initiation of a plasma generation, a cooling means for the torch in the form of annular chamber around the nozzle.

In the plasma process, a gas which is ionized in the torch regains its heat of ionization on exiting the nozzle to create a highly intense flame. In general, the flow of gas through the plasma spray apparatus is effected at speeds at least approaching the speed of sound. The typical torch comprises a conduit means having a convergent portion which converges in a downstream direction to a throat. The convergent portion communicates with an adjacent outlet opening so that the discharge of plasma is effected out the outlet opening.

Other types of torches may be used such an an oxyacetylene type having high pressure fuel gas flowing through the nozzle. The powder may be introduced into the gas by an aspirating effect. The fuel is ignited at the nozzle outlet to provide a high temperature flame.

Preferably the powders utilized for the torch should be uniform in size and composition. A relatively narrow size distribution is desirable because, under set flame conditions, the largest particles may not melt completely, and the smallest particles may be heated to the vaporization point. Incomplete melting is a detriment to the product uniformity, whereas vaporization and decomposition decreases process efficiency. Typically, the size ranges for plasma feed powders of this invention are such that 80 percent of the particles fall within about a 15 micrometer diameter range.

The stream of entrained molten metal droplets which issues from the nozzle tends to expand outwardly so that the density of the droplets in the stream decreases as the distance from the nozzle increases. Prior to impacting a surface, the stream typically passes through a gaseous atmosphere which solidifies and decreases the velocity of the droplets. As the atmosphere approaches a vacuum, the cooling and velocity loss is diminished. It is desirable that the nozzle be positioned sufficiently distant from any surface so that the droplets remain in a droplet form during cooling and solidification. If the nozzle is too close, the droplets may solidify after impact.

The stream of molten particles may be directed into a cooling fluid. The cooling fluid is typically disposed in a chamber which has an inlet to replenish the cooling fluid which is volatilized and heated by the molten particles and plasma gases. The fluid may be provided in liquid form and volatilized to the gaseous state during the rapid solidification process. The outlet is preferably in the form of a pressure relief valve. The vented gas may be pumped to a collection tank and reliquified for reuse.

The choice of the particle cooling fluid depends on the desired results. If large cooling capacity is needed, it may be desirable to provide a cooling fluid having a high thermal capacity. An inert cooling fluid which is non-flammable and nonreactive may be desirable if contamination of the product is a problem. In other cases, a reactive atmosphere may be desirable to modify the powder. Argon and nitrogen are preferable nonreactive cooling fluids. Hydrogen may be preferable in certain cases to reduce oxides and protect from unwanted reactions. Liquid nitrogen may enhance nitride formation. If oxide formation is desired, air, under selective oxidizing conditions, is a suitable cooling fluid.

Since the melting plasmas are formed from many of the same gases, the melting system and cooling fluid may be selected to be compatible.

The cooling rate depends on the thermal conductivity of the cooling fluid and the molten particles to be cooled, the size of the stream to be cooled, the size of individual droplets, particle velocity and the temperature difference between the droplet and the cooling fluid. The cooling rate of the droplets is controlled by adjusting the above mentioned variables. The rate of cooling can be altered by adjusting the distance of the plasma from the liquid bath surface. The closer the nozzle to the surface of the bath, the more rapidly cooled the droplets.

Powder collection is conveniently accomplished by removing the collected powder from the bottom of the collection chamber. The cooling fluid may be evaporated or retained if desired to provide protection against oxidation or unwanted reactions.

The particle size of the spherical powders will be largely dependent upon the size of the feed into the high temperature reactor. Some densification occurs and the surface area is reduced thus the apparent particle size is reduced. The preferred form of particle size measurement is by micromergraph, sedigraph or microtrac. A majority of the particles will be below about 20 micrometers or finer. The desired size will depend upon the use of the alloy. For example, in certain instances such as microcircuitry applications extremely finely divided materials are desired such as less than about 3 micrometers.

The powdered materials of this invention are essentially spherical particles which are essentially free of elliptical shaped material and essentially free of elongated particles having rounded ends, is shown in European patent application No. WO8402864.

Spherical particles have an advantage over non-spherical particles in injection molding and pressing and sintering operations. The lower surface area of spherical particles as opposed to non-spherical particles of comparable size, makes spherical particles easier to mix with binders and easier to dewax.

To further illustrate this invention, the following non-limiting example is presented. Al parts, proportions and percentages are by weight unless otherwise indicated.

EXAMPLE

About 650 parts of iron powder and about 350 parts of cobalt powder are dissolved in about 4000 parts of 10N HCl using a glass lined agitated reactor.

Ammonium hydroxide is added to a pH of about 6.5–7.5. The iron, and cobalt are precipitated as an intimate mixture of hydroxides. This mixture is then evaporated in dryness. The mixture is then heated to about 350° C. in air for about 3 hours to remove the excess ammonium chloride. This mixture is then hammer-milled to produce a power having greater than 50% of the particles smaller than about 50 micrometers with no particles larger than about 100 micrometers. These milled particles are heated in a reducing atmosphere of $H_2$ at a temperature of about 700° C. for about 3 hours. Finely divided particles containing 65% iron and 35% cobalt are formed.

The Fe, Co powder particles are entrained in an argon carrier gas. The particles are fed to a Metco 9MB plasma gun at a rate of about 10 pounds per hour. The gas is fed at the rate of about 6 cubic feet per hour. The plasma gas ($Ar+H_2$) is fed at the rate of about 70 cubic feet per hour. The torch power is about 11 KW at about 55 volts and 200 amperes. The molten droplets exit into a chamber containing inert gas. The resulting powder contains two fractions, the major fraction consists of the spherical shaped resolidified particles. The minor fraction consists of particles having surfaces which have been partially melted and resolidified.

While there has been shown and described what are considered the preferred embodiments of the invention, it will be obvious to those skilled in the art that various changes and modifications may be made therein without departing from the scope of the invention as defined by the appended claims.

What is claimed:

1. A process consisting essentially of:

(a) forming an aqueous solution containing at least one iron group metal value, (b) forming a reducible solid metallic material selected from the group consisting of iron group metal salts, oxides, hydroxides and mixtures thereof from said solution, (c) reducing said material to form iron group based metallic powder particles, (d) entraining at least a portion of said powder particle in a carrier gas to form entrained iron group metal powder particles, (e) feeding said entrained particles and said carrier gas into a high temperature zone and maintaining said particles in said zone for a sufficient time to melt at least about 50% by weight of said particles, and to form droplets therefrom and (f) cooling said droplets to form iron group metal based particles having essentially a spherical shape and a majority of said particles having a size less than 20 micrometers.

2. A process according to claim 1 wherein said solution contains a water soluble acid.

3. A process according to claim 2 wherein said reducible solid material is formed by evaporation of the water from the solution.

4. A process according to claim 2 wherein said reducible solid material is formed by adjusting the pH of the solution to form a solid which is separated from the resulting aqueous phase.

5. A process according to claim 1 wherein the material from step (b) is subjected to a particle size reduction step prior to the chemical reduction step (c).

6. A process according to claim 1 wherein the powder particles from step (c) are subjected to a particle size reduction step prior to the entraining step (d).

7. A process according to claim 1 wherein said iron group metal is iron.

8. A process according to claim 1 wherein said iron group metal is cobalt.

9. A process according to claim 1 wherein said iron group metal is nickel.

10. A process according to claim 1 wherein said high temperature zone is created by a plasma torch.

11. A process according to claim 1 wherein said carrier gas is an inert gas.

12. A process according to claim 1 wherein in step e essentially all of said iron group metal particles are melted.

13. A process according to claim 1 wherein at least 50% of said particles having essentially a spherical shape have a size less than about 10 micrometers.

* * * * *